United States Patent [19]

Zeck et al.

[11] Patent Number: 5,032,063

[45] Date of Patent: Jul. 16, 1991

[54] PRECISION FLUID PUMP

[75] Inventors: Ted E. Zeck; Paul F. Zeck, both of Snyder, Tex.

[73] Assignee: Y-Z Industries, Inc., Snyder, Tex.

[21] Appl. No.: 460,294

[22] Filed: Jan. 3, 1990

[51] Int. Cl.[5] ..... F04B 9/08; F04B 35/02

[52] U.S. Cl. ..... 417/383; 417/385; 91/402; 92/86; 92/162 R

[58] Field of Search ..... 417/53, 383, 385, 386, 417/387, 388, 435, 405; 92/86, 162 R; 91/402, 408, 409

[56] References Cited

U.S. PATENT DOCUMENTS

| | | | |
|---|---|---|---|
| 2,578,746 | 12/1951 | Saterger | 417/383 |
| 2,827,853 | 3/1958 | Bradley | 417/388 |
| 2,869,467 | 1/1959 | Limpert | 417/387 |
| 3,000,320 | 9/1961 | Ring | 417/383 |
| 3,030,892 | 4/1962 | Piccardo | 417/383 |
| 3,134,508 | 5/1964 | Bayer et al. | 417/383 |
| 3,168,045 | 2/1965 | Sebastiani | 417/383 |
| 3,257,952 | 6/1966 | McCormick | 417/383 |
| 4,068,982 | 1/1978 | Quarue | 417/387 |

*Primary Examiner*—Leonard E. Smith
*Assistant Examiner*—David L. Cavanaugh
*Attorney, Agent, or Firm*—Wendell Coffee

[57] ABSTRACT

Hydraulic fluid is replenished in a pulsator chamber of a fluid driven pulsator pump by having the power plunger in an upstanding bore with spaced seals. The power plunger is withdrawn upon each stroke vertically upward. As it is withdrawn past seals, any gas within the pulsator chamber may be purged or bled into an annular space and there out into a reservoir and scrubbing chamber. Additional hydraulic fluid will flow into the pulsator chamber. Upon the down stroke of the plunger an exact amount of volume will be displaced within the pulsator chamber. Adjustment of the product pumped on each stroke is by sacrificing a measured amount of the pulsator liquid into a sacrifice chamber. The amount of liquid which flows into the sacrifice chamber upon each down stroke and out of the chamber on each upstroke is adjusted by adjusting the movement of a floating piston by a micrometer rod.

3 Claims, 1 Drawing Sheet

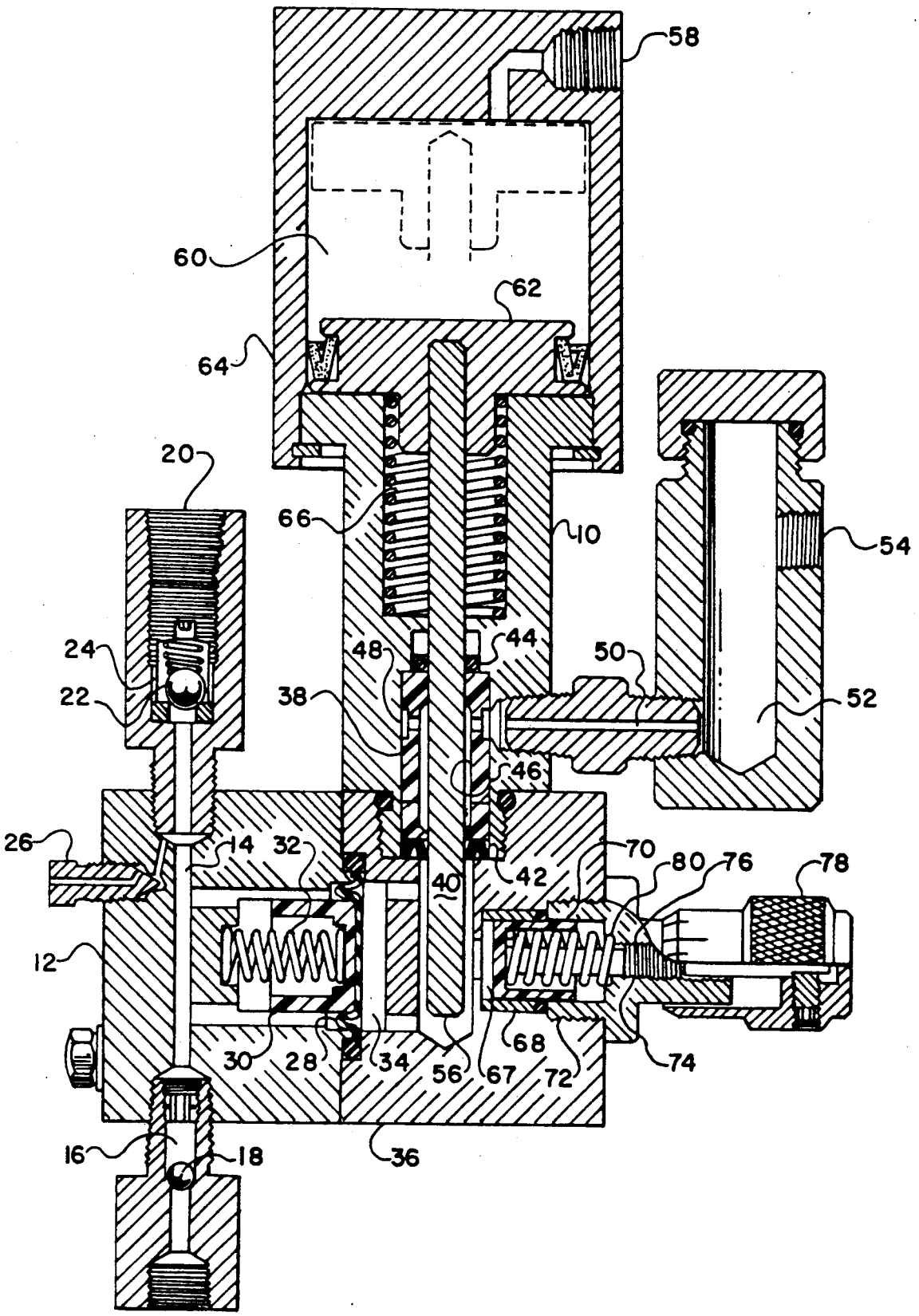
58
60
62
64
20
66
10
54
24
48
44
50
22
38
52
46
26
14
32
70
80
76
78
40
42
12
30
28
34
56
67
68
72
74
16
18
36

PRECISION FLUID PUMP

BACKGROUND OF THE INVENTION (1) Field of the Invention

This invention relates to fluid pumps and more particularly to a precision pump for adding a small adjustable precision amount of fluid to a process.

(2) Description of the Related Art

Pulsator pumps are well known to the art. In this type pump a product chamber which has an inlet and outlet valve and a diaphragm so that the volume of the product chamber is changeable. With the changing of the product chamber volume the product fluid will be pumped as is well known.

One common way of moving the diaphragm of the product chamber to change its volume is to use a fluid on the other side of the diaphragm. Pumps which utilize this method are well known; for example see SCHERGER, U.S. Pat. No. 2,578,746 or QUARVE, U.S. Pat. No. 4,068,982.

These pumps contain a pulsator fluid within the pulsator chamber which acts against the product diaphragm causing the pumping action A relief valve is used to release the positive pressure in the pulsator chamber after the diaphragm completes its stroke or "bottoms out". I.e., the design of the pump is such that the diaphragm moves between two set limits: one of which results in a maximum volume in the product chamber and the other results in a minimum volume in the product chamber. Therefore for each stroke of the pump an exactly identical amount of volume of product is displaced in the pump for every stroke. That precise volume is the maximum volume which the diaphragm is capable of displacing.

It will be noticed from SCHERGER and QUARVE, that different methods such as pressure sensitive valves and the like are known to be used to replenish the amount of liquid in the pulsator chamber and to also bleed any gas from the pulsator chamber that might become present.

Pulsator pumps are particularly adept for pumping toxic or highly volatile products. This is because there are no sealed moving parts holding the toxic liquid being pumped. I.e., there are no rotating elements or reciprocating elements extending from outside of the product chamber to inside the product chamber nor are there pistons requiring seals as in the case of a centrifugal pump or a reciprocating piston within a bore.

Before this patent application was filed applicants were aware of the following art of record in addition to SCHERGER or QUARVE, however, they do not consider any of the other patents more pertinent to their invention.

| | |
|---|---|
| 3,256,824 | Sebardt |
| 3,339,464 | Rietdijk |
| 3,680,981 | Wagner |
| 3,680,985 | Ginsberg |
| 3,704,858 | Dros |
| 4,378,201 | Quarve |
| 4,416,599 | DeLongchamp |
| 4,560,324 | Durieux |
| 4,564,340 | Stahlkopf |

SUMMARY OF THE INVENTION (1) Progressive Contribution to the Art

This invention provides a fluid driven pulsator pump in the change of volume of the product chamber which is the displacement of the diaphragm into the product chamber is always to the net displacement of liquid in the pulsator chamber. I.e., the amount of fluid pumped on each stroke is dependent upon the change of total adjusted volume within the pulsator chamber and not the fact that the diaphragm moves to its capability with each stroke. The term of the capability of movement of the product diaphragm as used, it is meant that this is the capacity to move or its the maximum ability it is capable of moving. I.e., that there is limits that the diaphragm will "bottom out" or top out. It is between these limits of bottoming out and topping out that is the total displacement it is capable of or it is the total capacity for displacement that the product diaphragm has. By operating so that the displacement within the pulsator chamber is less than the capabilities of the product diaphragm therefore the amount of product pumped with each stroke will always be equal to the net displacement (sometimes called the change of total adjusted volume) within the pulsator chamber.

The pulsator chamber itself is a rigid body and the amount of fluid displaced by each stroke of the pump is the volume of a plunger which enters the pulsator chamber. I.e., this invention uses a plunger to displace the volume of the liquid within the pulsator chamber. This liquid will be non compressable and normally be hydraulic fluid. The term hydraulic fluid may be used interchangeably with pulsator liquid in this application. Therefore, if the displacement of the plunger is exactly the same each stroke then the displacement of the product chamber will be the same because of the flexible diaphragm used to separate the pulsator chamber from the product chamber.

We prefer to use a fluid motor to operate the plunger. Because the plunger is rigidly attached to the power piston, the plunger travels a distance equal to the movement of the power piston. The power piston travel is fixed. All of those with skill in the art understand that the power could be mechanical power as seen in the SCHERGER et al patent or it could also be an electrical motor such as a solenoid coil causing the plunger to reciprocate according to electrical pulses energizing the solenoid coil. For the purposes of this invention all of these means for moving the plunger are equivalent.

The plunger is mounted for vertical reciprocation with the power plunger extending vertically upward from the pulsator chamber. The plunger reciprocates within a sleeve which has a lower seal and an upper seal and an annular space in between. The plunger is removed from the pulsator chamber above the lower seal on each stroke. Therefore the effective displacement of the plunger in each case is from the seal downward till the plunger structure bottoms out. The plunger rises above the seal each stroke. Any gas which may be in the pulsator chamber will escape to the annular space above the lower seal. This gas will be bled off. Also each time when the plunger is on the downward stroke as the bottom of the plunger passes the lower seal, the pulsator chamber will be full of hydraulic fluid. Therefore we have provided a simple way of bleeding gas from the pulsator chamber and replenishing hydraulic fluid to the hydraulic chamber and still have a constant volume displacement for each stroke of the plunger by which the product amount may be regulated.

In order to adjust the amount of product pumped on each stroke of the plunger, a sacrifice chamber is used. Actually the sacrifice varies the volume of displacement of fluid within the pulsator chamber. With the flexible diaphragm between the pulsator chamber and the product chamber, the change in volume at each stroke will be identical in each chamber.

The sacrifice chamber includes a floating piston which is spring loaded to a closed position. The closed position being that position where the pulsator chamber has a minimum volume.

When the plunger enters the pulsator chamber a certain volume of the hydraulic fluid will be displaced into the sacrifice chamber because the spring biasing the floating piston outward is quite weak. The floating piston will be displaced until it is stopped by an adjustment rod. Analysis will show therefore, that the volume of product pumped upon each stroke will be the volume of the plunger displacement from the lower seal minus the amount of hydraulic fluid sacrificed because of the movement of the floating piston.

It will be readily apparent that a screw micrometer could be used to obtain a precision calibrated adjustment of the adjustment rod.

(2) Objects of this Invention

An object of this invention is to pump a precision amount of fluid.

Another object of this invention is to pump an adjustable precise amount of fluid.

A further object of this invention is to have the fluid which is pumped in a sealed pump wherein loss of the product is highly improbable.

Further objects are to achieve the above with devices that are sturdy, compact, durable, lightweight, simple, safe, efficient, versatile, ecologically compatible, energy conserving, and reliable, yet inexpensive and easy to manufacture, adjust, operate and maintain.

Other objects are to achieve the above with a method that is rapid, versatile, ecologically compatible, energy conserving, efficient, and inexpensive, and does not require highly skilled people to connect, adjust, operate, and maintain.

The specific nature of the invention, as well as other objects, uses, and advantages thereof, will clearly appear from the following description and from the accompanying drawing.

BRIEF DESCRIPTION OF THE DRAWINGS

The drawing represents a sectional view of a pump according to this invention.

As an aid to correlating the terms of the claims to the exemplary drawing, the following catalog of elements and steps if provided:

| | |
|---|---|
| 10 housing | 46 annular space |
| 12 casing | 48 port |
| 14 product chamber | 50 bleed conduit |
| 16 product inlet | 52 reservoir |
| 18 inlet valve | 54 outlet |
| 20 product outlet | 56 lower tip |
| 22 outlet valve | 58 power inlet |
| 24 outlet spring | 60 power chamber |
| 26 bleed outlet | 62 power piston |
| 28 rolling product diaphragm | 64 power cylinder |
| 30 guide element | 66 spring |
| 32 spring | 67 sacrifice chamber |

-continued

| | |
|---|---|
| 34 pulsator chamber | 68 sacrifice sleeve |
| 36 subhousing [block] | 70 floating piston |
| 38 sleeve | 72 O-ring |
| 40 plunger | 74 adjustment rod |
| 42 lower seal | 76 micrometer screw |
| 44 upper seal | 78 knurled nut |
| | 80 spring |

DESCRIPTION OF THE PREFERRED EMBODIMENT

Referring to the drawing there may be seen an embodiment of this invention. This embodiment includes housing 10. The housing is not a single unified integral unit but includes different blocks of metal which have been appropriately machined. For example, casing 12 might be considered the product subhousing. Cavity or product chamber 14 is in the casing 12. The product chamber has inlet 16 which includes inlet valve 18 which permits inward flow of fluid only. As is common with these type pumps, inlet 16 is adapted to be connected to a source or supply of product which is to be pumped.

The product chamber 14 will also have outlet 20 having outlet valve 22 which permits outward flow of fluid only. According to this embodiment the outlet valve will be biased to a closed position by spring 24. The inlet valve 18 is not spring loaded. Thus the product may be supplied to the product chamber 14 at extremely low pressures without the product vaporizing because of a reduction in pressure. The product chamber might be below atmospheric pressure so long as that pressure is sufficient to maintain the fluid within the product chamber in a liquid state. To allow for precise measurement of the product it is desirable that the product be in the liquid state.

To facilitate the evacuation of the product chamber for the purposes of repair or maintenance, bleed or drain outlet 26 is provided. However, in all normal operating situations, the bleed 26 would be in a closed position.

The volume of the product chamber 14 is changed by rolling product diaphragm 28. Rolling diaphragms are well known to the art and are commercially available on the market. The diaphragm includes guide element 30. The guide element 30 is spring biased to a position to increase the volume of the product chamber by spring 32.

Pulsator chamber 34 is contained in subhousing or block 36 a portion of the housing 10. Sleeve 38 is attached to the block 36 containing the pulsator chamber. The sleeve 38 has a cylindrical bore therethrough and is connected to the pulsator chamber 34. Plunger 40 is reciprocally mounted in the sleeve 38 so that in its lowermost position (as shown in full line in the drawing) the plunger is fully extended into the pulsator chamber. Sleeve 38 has lower seal 42 at its lower end which also defines the top of the pulsator chamber. Upper seal 44 is at the top of sleeve 38 and away from the pulsator chamber 34. Seals 42 and 44 seal the plunger 40 to the cylindrical bore of sleeve 38. Annular space 46 is between the plunger 40 and the sleeve 38 and also between the lower seal 42 and the upper seal 44. Port 48 connects the annular space 46 to bleed conduit 50. The bleed conduit 50 connects the upper part of annular space 46 to the lower part of reservoir 52. The reservoir is a closed container which has an outlet 54 at the upper part of the reservoir 52.

When the plunger 40 is raised into its upper most position, lower tip 56 of the plunger will be within the annular space 46. In this position, any gas within the pulsator chamber 34 will flow into the annular space above the lower seal 42 which defines the top of the pulsator chamber. The gas will then rise to the top of the annular space, out the bleed conduit 50 and into reservoir 52. From reservoir 52 the gas flows out the outlet 54. The outlet may be connected to a scrubber or the like to remove the gas if there is a possibility that the gas may be toxic. Outlet 54 could also be connected to a gas analyzer to determine if gas from the product within the product chamber 14 was leaking into the hydraulic oil within the pulsator chamber 34. Normally, reservoir 52 will contain a surplus of hydraulic fluid which is used to fill annular space 46. Therefore, if there is any loss of hydraulic fluid from the pulsator chamber it will be replenished with each upward stroke of plunger 40.

This replenishment is accomplished when the lower tip 56 of the plunger 40 rises above lower seal 42 and some gas is present. The gas will move up the annular space toward the port 48 of the bleed conduit 50. The excess fluid in the annular space 46 will flow in to fill the space where the gas has been removed. The effect of this exchange is to assure that the pulsator chamber is filled only with the desired hydraulic fluid which is much more resistant to compression than gas.

The preferred source of power is a fluid power unit which is shown. A pulsating fluid enters through power inlet 58 into power chamber 60. The fluid forces power piston 62 downward until it bottomed out against power cylinder 64 which might be considered to be a part of a subhousing of the main housing 10. This is the full line position shown in the drawing. After the piston 62 has bottomed out the pressure is relieved at inlet 58 and spring 66 returns the power piston 62 to the upper position until it tops out against the top of the power cylinder 64. This position is shown in partial dashed lines. As discussed above, the power unit could be either fluid as described in detail or electric or mechanical. For this invention it is necessary that the power piston have a fixed stroke. It is possible that the amount of product pumped could be varied by adjusting the length of the stroke, but, we find it a design advantage, and easier to construct and more reliable in operation to use sacrifice chamber 67, as described hereafter.

The sacrifice chamber 67 is in the form of a cylindrical bore formed within sacrifice sleeve 68 within the block 36. The cavity or chamber 67 formed by the cylindrical bore of the sleeve 68 is open to or in communication with the pulsator chamber 34. Floating piston 70 is telescoped within the bore of sleeve 68. O-ring 72 forms a fluid seal between the piston and sleeve. The piston 70 floats between two extreme positions. One extreme is the position where it bears against the end of the cavity near the plunger 40. In this position there is zero or no sacrifice volume. The other extreme position to which the piston 70 may be adjusted is so it bears against the completely retracted adjustment rod 74. The adjustment rod is connected to micrometer screw 76 which is controlled by knurled nut 78. The adjusting mechanism is described as a micrometer adjustment because the total movement of the floating piston 70 can be adjusted and calibrated to any position between the two extremes. The floating piston is biased by spring 80 toward the minimum sacrifice volume position which is away from the adjusting rod 74.

The spring 80 is a weak spring. I.e., a very low pressure of pulsator liquid will collapse the spring 80 so that the fluid readily flows into the sacrifice chamber 67. It is substantially weaker than the spring 32 which requires a higher pressure within the pulsator liquid before it collapses and causes the pumping of the product in the product chamber 14.

When the adjustment rod 74 is set to its most fully extended position pushing the floating piston 70 against its minimum position stop, there will be no sacrifice and therefore the displacement of the plunger 40 from the lower seal 42 downward will be equal to the volume of product pumped through the inlet valve 18 and the outlet valve 22. However, as the adjustment rod 74 is withdrawn from this position a lesser amount of fluid will be pumped and this amount may be readily set because of the scales upon the micrometer knurled nut 78. The reduction in pumped volume will equal the corresponding increase in volume of the sacrifice chamber as the adjustment rod 74 is backed out.

As a matter of construction we prefer to use a synthetic material such as :"DELRIN" a trademark of Dupont Corporation to form certain moving parts within the element. Other wear resistant, non-abrasive, and low friction materials are suitable. Specifically we prefer to use "DELRIN" to form the guide element 30 within the product chamber, and to form the sleeve 38 through which the plunger 40 reciprocates and to form the sleeve 68 that guides the floating piston 70.

It is to be understood that the floating piston is sealed by the O-ring 72, the plunger is sealed by its lower and upper seals 42 and 44, and the guide 30 guides the rolling product diaphragm 28.

The embodiment shown and described above is only exemplary. We do not claim to have invented all the parts, elements or steps described. Various modifications can be made in the construction, material, arrangement, and operation, and still be within the scope of our invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. In a precision fluid pump including a. a housing, b. a product chamber in the housing having i. an inlet fluidly connected to the chamber with an inlet valve means for permitting fluid to flow into the product chamber only, ii. an outlet fluidly connected to the chamber with an outlet valve means for permitting fluid to flow from the product chamber only, c. a pulsator chamber in the housing, d. pulsator liquid in the pulsator chamber, e. a product diaphragm in the housing separating the pulsator chamber from the product chamber, f. a cylindrical power bore in the housing fluidly connected to the pulsator chamber, g. a power plunger having, a lower tip reciprocatively mounted in the cylindrical power bore, h. plunger seals in the cylindrical power bore for fluidly sealing the power plunger to the power bore, and j. power means connected to the housing for reciprocating the power plunger so that the plunger has a down stroke;

k. wherein the improvement comprises:

l. a first of said plunger seals adjacent said pulsator chamber m. a second of said plunger seals away from said pulsator chamber, n. an annular space between said plunger and cylindrical power bore between said first and second plunger seals, o. said annular space having an upper part, p. a reservoir of pulsator liquid having a lower part, and q. a bleed conduit fluidly connecting to the upper part of the annular space to the lower part of the reservoir.

2. The invention as defined in claim 1 further comprising:

r. said power means moving the lower tip of the plunger above the first of said plunger seals each reciprocation thereof.

3. The invention as defined in claim 1 further comprising:

r. said product diaphragm mounted to have a displacement capacity greater than the displacement capacity of said plunger, s. a sacrifice chamber fluidly connected to said pulsator chamber, t. a floating piston in the sacrifice chamber for changing the volume of the sacrifice chamber, u. one side of said floating piston fluidly connected to said pulsator chamber, v. a precision moveable rod limiting the travel of the floating piston away from the pulsator chamber, w. a sacrifice spring in the sacrifice chamber biasing the floating piston toward the pulsator chamber, and x. a product spring in the product chamber biasing the product diaphragm toward the pulsator chamber, y. said product spring exerting greater pressure upon the pulsator liquid than exerted by said sacrifice spring.

* * * * *